US009365917B1

(12) United States Patent
Chen et al.

(10) Patent No.: US 9,365,917 B1
(45) Date of Patent: Jun. 14, 2016

(54) METHOD OF HEAT TREATING ALUMINUM—LITHIUM ALLOY TO IMPROVE FORMABILITY

(71) Applicant: The United States of America as Represented by the United States National Aeronautics and Space Administration, Washington, DC (US)

(72) Inventors: Po-Shou Chen, Huntsville, AL (US); Carolyn Kurgan Russell, Huntsville, AL (US)

(73) Assignee: The United States of America as Represented by the Administrator of the National Aeronatics and Space Administration, Washington, DC (US)

( * ) Notice: Subject to any disclaimer, the term of this patent is extended or adjusted under 35 U.S.C. 154(b) by 297 days.

(21) Appl. No.: 14/223,649

(22) Filed: Mar. 24, 2014

(51) Int. Cl.

| | |
|---|---|
| ***C22F 1/057*** | (2006.01) |
| ***C22F 1/04*** | (2006.01) |
| ***C22C 21/16*** | (2006.01) |
| ***C22C 21/00*** | (2006.01) |
| ***C21D 1/84*** | (2006.01) |

(52) U.S. Cl.
CPC . *C22F 1/057* (2013.01); *C21D 1/84* (2013.01); *C22C 21/00* (2013.01); *C22C 21/16* (2013.01); *C22F 1/04* (2013.01)

(58) Field of Classification Search
CPC ..... C22F 1/057; C22F 1/04
USPC ..... 148/552
See application file for complete search history.

(56) References Cited

U.S. PATENT DOCUMENTS

2002/0157742 A1* 10/2002 Cho ..... C22F 1/053 148/701
2012/0291925 A1* 11/2012 Bes ..... C22C 21/06 148/552

* cited by examiner

*Primary Examiner* — Weiping Zhu
(74) *Attorney, Agent, or Firm* — Peter J. Van Bergen; James J. McGroary

(57) ABSTRACT

A method is provided for heat treating aluminum-lithium alloys to improve their formability. The alloy is heated to a first temperature, maintained at the first temperature for a first time period, heated at the conclusion of the first time period to a second temperature, maintained at the second temperature for a second time period, actively cooled at the conclusion of the second time period to a third temperature, maintained at the third temperature for a third time period, and then passively cooled at the conclusion of the third time period to room temperature.

15 Claims, 2 Drawing Sheets

METHOD OF HEAT TREATING ALUMINUM—LITHIUM ALLOY TO IMPROVE FORMABILITY

ORIGIN OF THE INVENTION

The invention described herein was made in the performance of work under a NASA contract and by an employee of the United States Government and is subject to the provisions of Public Law 96-517 (35 U.S.C. §202) and may be manufactured and used by or for the Government for governmental purposes without the payment of any royalties thereon or therefore. In accordance with 35 U.S.C. §202, the contractor elected not to retain title.

BACKGROUND OF THE INVENTION

1. Field of the Invention

This invention relates to heat treatment processes for aluminum-lithium alloys. More specifically, the invention is a heat treatment process for aluminum-lithium alloys that will improve the alloys' formability into curved shapes.

2. Description of the Related Art

Large rocket domes are typically fabricated using aluminum-copper (Al—Cu) based alloys such as the Al—Cu alloy 2219. In order to be acceptable for rocket fuel tank applications, the aluminum alloy must possess requisite characteristics of strength, fracture toughness, and corrosion resistance. When used for a rocket dome, the aluminum alloy must also possess good formability to achieve the needed shape.

A lower overall rocket weight could be achieved through the use of aluminum-lithium based alloys as the material for rocket fuel tank domes because aluminum-lithium alloys have lower density and higher strength than the Al—Cu alloy 2219. However, aluminum-lithium alloys have rarely been used to fabricate rocket fuel tank domes because of the alloy's inherent low formability that make them susceptible to cracking during the forming operations.

Large rocket fuel tank domes can be manufactured using stretch forming or spin forming methods. Manufacturing a dome by stretch forming typically requires eight gore panels, or pie shaped pieces, 10 welding steps, and multiple operations and inspections to assemble these pieces into a full-scale fuel tank dome. Each gore panel requires stretch forming at room temperature to a large degree of forming. However, complex tensile and bending stresses induced during the stretch forming operations combined with the inherent low stretch formability of aluminum-lithium alloys cause high failure rates.

A large rocket fuel tank dome can also be manufactured by spin forming. To spin form a large rocket dome whose typical diameter is over 18 feet, the spin blank must be prepared by joining two smaller plates together using the friction stir welding (FSW) method. This is because the size of the aluminum-lithium alloy blank needed for spin forming is larger than commercially-available blanks. The welded blank is then spun formed to create a single-piece dome.

Certain technical challenges must be overcome when spin forming an aluminum-lithium alloy blank that includes FSW joint(s). The FSW process produces three zones that have distinct metallurgical structures inside and around the friction stir weld. The zone that is affected by the most severe plastic deformation is called the "nugget". The second zone on each side of the nugget is the "thermo-mechanically affected zone", which deforms to a lesser extent. The third zone is called the "heat affected zone" and is formed by the heat generated during FSW.

The as-welded blank is generally not suitable for spin forming because there is an unequal hardness distribution in the weld nugget, the thermo-mechanically affected zone, the heat affected zone, and the base material that is outside of these zones. This leads to an inhomogeneous forming behavior and uneven material thinning between the nugget and the base material. Therefore, the as-welded blank must be heat treated prior to spin forming.

To spin form an aluminum-lithium alloy blank joined by FSW, the hardness distribution across the spin blank must be equalized by a heat treatment called "post weld anneal". More importantly, the formability for such blanks should not be adversely affected by this post weld annealing treatment.

Conventional post weld anneal processes typically use a simple "heat and hold" process that heats the blank to some elevated temperature and holds it there for some period of time before cooling. However, conventional post weld anneal processes applied to aluminum-lithium alloys have proven to be incapable of equalizing the hardness of a friction stir welded blank and obtaining the needed formability for spin forming. More specifically, after the conventional post weld anneal, the nugget zone always exhibits higher hardness than the other zones. Consequently, the weld nugget zone is very susceptible to cracking during spin forming. Thus, the low formability issues associated with lightweight aluminum-lithium alloys has limited the use of these alloys for large rocket fuel tank dome applications.

SUMMARY OF THE INVENTION

Accordingly, it is an object of the present invention to provide a heat treating method that can enhance the formability of aluminum-lithium alloys.

Another object of the present invention is to provide a heat treating method that improves the formability of aluminum-lithium alloys used in the manufacture of large scale rocket domes.

Other objects and advantages of the present invention will become more obvious hereinafter in the specification and drawings.

In accordance with the present invention, a method is provided for heat treating aluminum-lithium alloys to improve formability. The aluminum-lithium alloy has 2.0 to 5% by weight of copper, 0.5 to 2.5% by weight of lithium, 0.1 to 1.0% by weight of magnesium, 0.1 to 1.0% by weight of silver, 0.05 to 0.15% by weight of zirconium, and a balance by weight of aluminum. The aluminum-lithium alloy is heated to a first temperature within the range of approximately 400° F. to approximately 650° F. The aluminum-lithium alloy is maintained at the first temperature for a first time period not to exceed 16 hours. The aluminum-lithium alloy is then heated at the conclusion of the first time period to a second temperature within the range of approximately 700° F. to approximately 900° F. The aluminum-lithium alloy is maintained at the second temperature for a second time period not to exceed 12 hours. The aluminum-lithium alloy is then actively cooled at the conclusion of the second time period to a third temperature within the range of approximately 400° F. to approximately 600° F. The aluminum-lithium alloy is maintained at the third temperature for a third time period not to exceed 4 hours. Finally, the aluminum-lithium alloy is passively cooled at the conclusion of the third time period to room temperature.

BRIEF DESCRIPTION OF THE DRAWING(S)

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

The present invention is a method of heat treating an aluminum-lithium alloy to improve the alloy's formability thereby making the alloy a suitable candidate for use in manufacturing large rocket domes. The aluminum-lithium alloys referred to herein are a class of aluminum-lithium alloys having the following general formulation:

2.0 to 5% by weight of copper, 0.5 to 2.5% by weight of lithium, 0.1 to 1.0% by weight of magnesium, 0.1 to 1.0% by weight of silver, 0.05 to 0.15% by weight of zirconium, and a balance by weight of aluminum.

Figure 1:
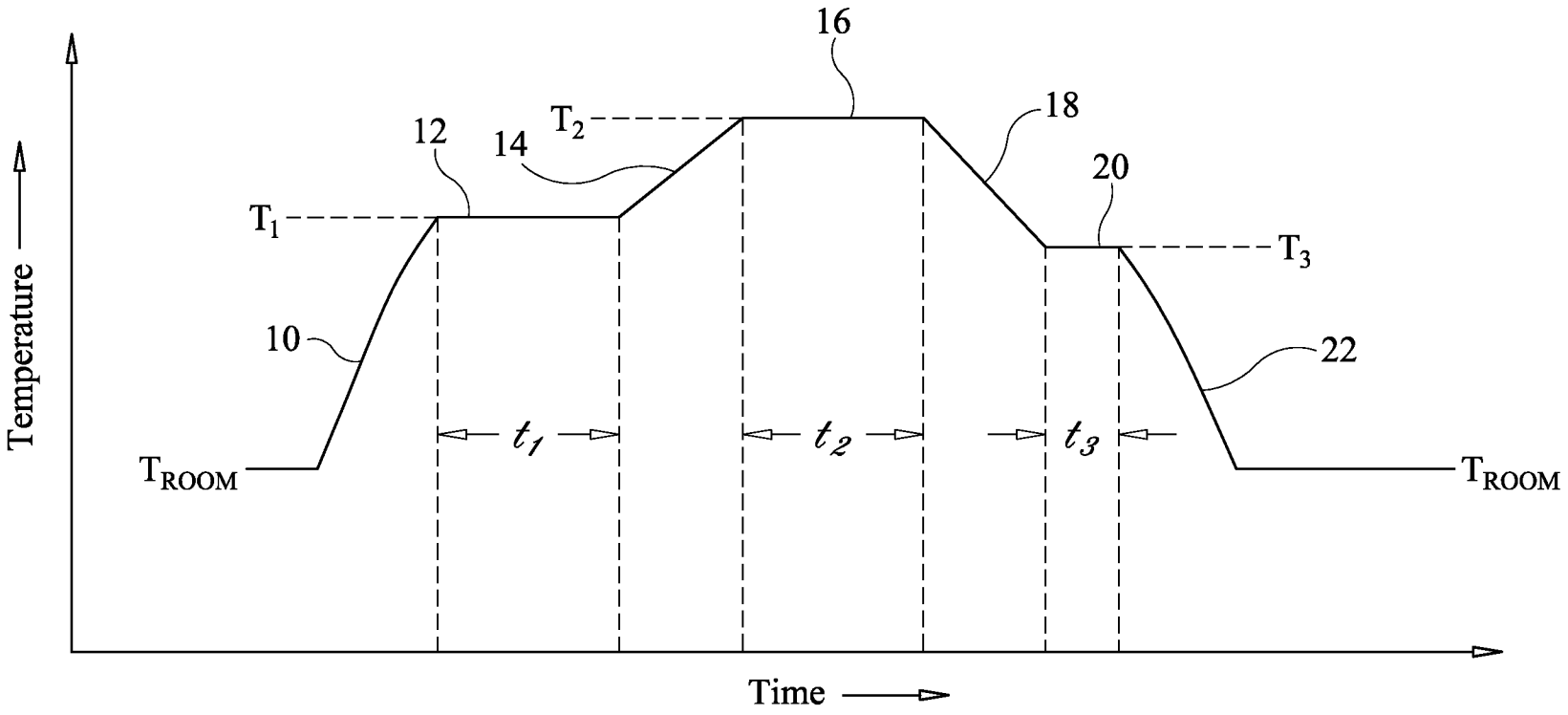
FIG. 1 is a graphic depiction of the general method steps for the heat treating method of aluminum-lithium alloys in accordance with the present invention.

The method of the present invention includes multiple heating steps followed by multiple cooling steps. The general format of the method is depicted graphically by the time-temperature curve shown in FIG. 1. The process begins with the alloy (e.g., in plate form) being at room temperature ($R_{ROOM}$). The alloy is heated (as indicated by reference numeral 10 on the curve) to a first temperature ($T_1$) that is in the range of approximately 400° F. to approximately 600° F. Once at temperature $T_1$, the alloy is maintained (as indicated by reference numeral 12 on the curve) at $T_1$ for a first time period ($t_1$) that should not exceed 16 hours. At the conclusion of $t_1$, the alloy is again heated (as indicated by reference numeral 14 on the curve) to a second temperature ($T_2$) that is in the range of approximately 700° F. to approximately 900° F. Heating step 14 occurs at a controlled rate that is at least 37° F. per hour. Once at temperature $T_2$, the alloy is maintained (as indicated by reference numeral 16 on the curve) at $T_2$ for a second time period ($t_2$) that should not exceed 12 hours. At the conclusion of $t_2$, the alloy is actively cooled (as indicated by reference numeral 18 on the curve) to a third temperature ($T_3$) in the range of approximately 400° F. to approximately 600° F. Active cooling step 18 (e.g., via control of a programmable furnace as is known in the art) is carried out at a controlled rate of at least 37° F. per hour. Once at temperature $T_3$, the alloy can be maintained (as indicated by the reference numeral 20 in the curve) at $T_3$ for a third time period ($t_3$) into to exceed 4 hours. At the conclusion of $t_3$, the alloy is placed in a room temperature environment and allowed to passively cool to room temperature ($T_{Room}$). The particular target temperatures ($T_1$, $T_2$ and $T_3$), time periods ($t_1$, $t_2$ and $t_3$), heating rate of heating step 14, and cooling rate of cooling step 18, can be adjusted based on the particular aluminum-lithium alloy.

By way of an illustrative example, the method of the present invention as applied to the aluminum-lithium alloy 2195 (Al—Li 2195) and resulting improved formability will be described below. As is known in the art, the formulation for Al—Li 2195 is as follows:

3.5 to 4.5% by weight of copper, 0.8 to 1.2% by weight of lithium, 0.2 to 0.6% by weight of magnesium, 0.2 to 0.6% by weight of silver, 0.05 to 0.15% by weight of zirconium, and a balance by weight of aluminum.

The above-described temperatures, time periods, and heating/cooling rates used to heat treat 0.525 inch thick and 0.75 inch thick Al—Li 2195 plates were as follows:

$T_1$ was approximately 600° F.;

$T_2$ was approximately 800° F.;

$T_3$ was approximately 500° F.;

$t_1$ was approximately 15 minutes;

$t_2$ was approximately 4 hours;

$t_3$ was zero;

heating rate for heating step 14 was approximately 50° F. per hour; and cooling rate for cooling step 18 was approximately 50° F. per hour.

Formability of the Al—Li 2195 plates heat treated to the above-described specifications was compared to the formability of 0.525 inch thick and 0.75 inch thick plates of Al—Li 2195 plates that underwent a conventional "heat and hold" heating process. Tensile testing was performed along the sample's longitudinal direction at a strain rate of 0.05 inches/inches/minute to determine the tensile properties and strain hardening exponent. The effects of the present invention's heat treatment as compared to conventionally heat treated samples in terms of tensile properties are shown in Table 1 where samples 1 and 2 were processed in accordance with the present invention and samples 3 and 4 were processed in accordance with a conventional "heat and hold" process.

TABLE 1

| Sample | Thickness (inch) | Yield Stress (ksi) | Tensile Stress (ksi) | Fracture elongation (%) | Forming Range |
|---|---|---|---|---|---|
| 1 | 0.75 | 14.85 | 31.55 | 17.25 | 16.7 |
| 2 | 0.525 | 14.29 | 31.31 | 16.7 | 17.02 |
| 3 | 0.75 | 19.8 | 31.59 | 16.3 | 11.79 |
| 4 | 0.525 | 21.93 | 32.7 | 17.45 | 10.76 |

In general, a lower value of yield stress combined with a higher value of tensile stress result in greater formability. Therefore, the forming range, which is the difference between the tensile stress and yield stress, was used to measure the formability. Generally, a higher value of forming range leads to greater formability. For both 0.525 inch and 0.75 inch plate samples, it is apparent that the present invention's heat treatment yields more than 50% improvement in overall formability.

A sample's strain hardening exponent can be determined by using the true stress-true strain curve obtained from tensile testing. A simple power-curve relation can express the flow curve of many metals in the region of uniform plastic deformation, i.e., from yielding up to the maximum load. The following equation describes the true stress-true strain correlation during the tensile testing:

$$\sigma = K\varepsilon^n \quad n = \left(\frac{\partial \ln\sigma}{\partial \ln\varepsilon}\right)_\varepsilon$$

where

σ=true stress k=the strength coefficient

ϵ=true strain n=strain hardening exponent.

The strain hardening exponent, n, is the slope of the true stress-true strain curve when plotted on logarithmic coordinates. A high strain hardening exponent is beneficial to a material's ability to uniformly distribute the imposed strain. The higher the value of the strain hardening exponent, the more a piece of material can be formed prior to excessive thinning.

Figure 2A:
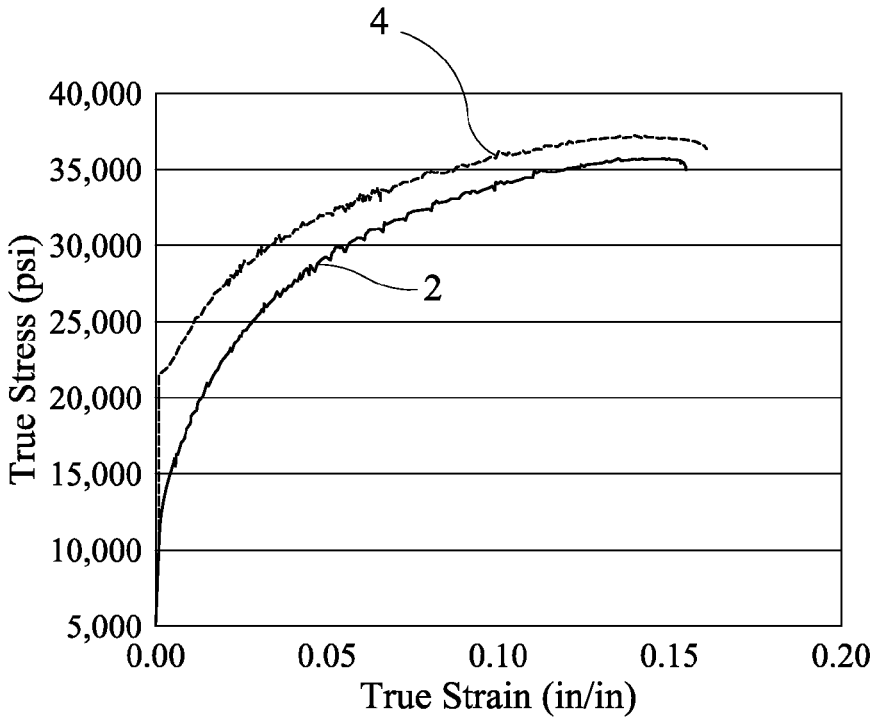
FIG. 2A illustrates true stress-strain curves for 0.525 inch aluminum-lithium 2195 plates undergoing conventional heat treatment and heat treatment in accordance with the present invention.
Figure 2B:
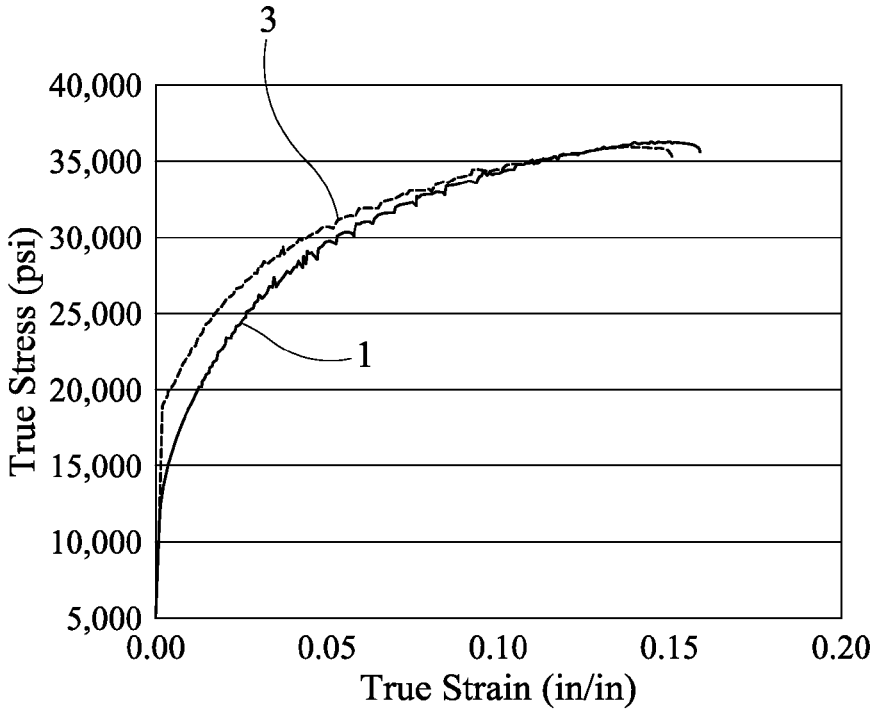
FIG. 2B illustrates true stress-strain curves for 0.75 inch aluminum-lithium 2195 plates undergoing conventional heat treatment and heat treatment in accordance with the present invention.

FIGS. 2A-2B illustrate true stress versus true strain curves for the Al—Li 2195 plates that received the different heat treatments. The curves referenced by numerals 1-4 correspond to the above-noted samples 1-4. It can be seen that the type of heat treatment has profound effects on the tensile behavior. More specifically, conventional "heat and hold" processing (associated with samples 3 and 4) results in high yield strength but reduced strain hardening. The present invention's heat treatment (associated with samples 1 and 2) reduces the yield strength and, therefore, significantly increases the strain hardening response.

Table 2 compares the average strain hardening exponent from 1-5% and 5-9% obtained from the sample plates. It can be seen from Table 2 that the strain hardening exponent is greater following the present invention's heat treatment. This is true for both the 0.75 inch and 0.525 inch plates. Thus, the tensile test results clearly indicate that heat treating the Al—Li alloy plate in accordance with the present invention provides a strain hardening exponent that is superior to what is typically obtained when using conventional "heat and hold" processing.

TABLE 2

| Sample | Thickness (inch) | Strain Hardening, n (1 to 5% strain) | Strain Hardening, n (5 to 9% strain) |
|---|---|---|---|
| 1 | 0.75 | 0.31 | 0.29 |
| 2 | 0.525 | 0.32 | 0.3 |
| 3 | 0.75 | 0.23 | 0.25 |
| 4 | 0.525 | 0.2 | 0.23 |

The advantages of the present invention are numerous. Commercially-available aluminum-lithium alloys can be processed in accordance with a stepped heating/cooling process to improve the alloy's formability. This will allow the alloy to be more readily shaped by stretch or spin forming processes. The alloy's improved formability will permit its use in the manufacture of large-scale rocket domes leading to a reduction in overall rocket weight.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A method for heat treating aluminum-lithium alloys to improve formability, comprising the steps of:

providing an aluminum-lithium alloy having 2.0 to 5% by weight of copper, 0.5 to 2.5% by weight of lithium, 0.1 to 1.0% by weight of magnesium, 0.1 to 1.0% by weight of silver, 0.05 to 0.15% by weight of zirconium, and a balance by weight of aluminum;

heating the aluminum-lithium alloy to a first temperature within the range of approximately 400° F. to approximately 650° F.;

maintaining the aluminum-lithium alloy at said first temperature for a first time period not to exceed 16 hours;

heating the aluminum-lithium alloy at the conclusion of said first time period to a second temperature within the range of approximately 700° F. to approximately 900° F.;

maintaining the aluminum-lithium alloy at said second temperature for a second time period not to exceed 12 hours;

actively cooling the aluminum-lithium alloy at the conclusion of said second time period to a third temperature within the range of approximately 400° F. to approximately 600° F.;

maintaining the aluminum-lithium alloy at said third temperature for a third time period not to exceed 4 hours; and passively cooling the aluminum-lithium alloy at the conclusion of said third time period to room temperature.

2. A method according to claim 1, wherein said step of heating the aluminum-lithium alloy at the conclusion of said first time period is carried out in accordance with a heating rate.

3. A method according to claim 2, wherein said heating rate is at least 37° F. per hour.

4. A method according to claim 2, wherein said heating rate is approximately 50° F. per hour.

5. A method according to claim 1, wherein said step of actively cooling is carried out in accordance with a cooling rate.

6. A method according to claim 5, wherein said cooling rate is at least 37° F. per hour.

7. A method according to claim 5, wherein said cooling rate is approximately 50° F. per hour.

8. A method for heat treating aluminum-lithium alloys to improve formability, comprising the steps of:

providing an aluminum-lithium alloy having 2.0 to 5% by weight of copper, 0.5 to 2.5% by weight of lithium, 0.1 to 1.0% by weight of magnesium, 0.1 to 1.0% by weight of silver, 0.05 to 0.15% by weight of zirconium, and a balance by weight of aluminum;

heating the aluminum-lithium alloy to a first temperature within the range of approximately 400° F. to approximately 650° F.;

maintaining the aluminum-lithium alloy at said first temperature for a first time period not to exceed 16 hours;

heating the aluminum-lithium alloy at a controlled heating rate at the conclusion of said first time period to a second temperature within the range of approximately 700° F. to approximately 900° F., said controlled heating rate being at least 37° F. per hour;

maintaining the aluminum-lithium alloy at said second temperature for a second time period not to exceed 12 hours;

actively cooling the aluminum-lithium alloy at a controlled cooling rate at the conclusion of said second time period to a third temperature within the range of approximately 400° F. to approximately 600° F., said controlled cooling rate being at least 37° F. per hour;

maintaining the aluminum-lithium alloy at said third temperature for a third time period not to exceed 4 hours; and passively cooling the aluminum-lithium alloy at the conclusion of said third time period to room temperature.

9. A method according to claim 8, wherein said controlled heating rate is approximately 50° F. per hour.

10. A method according to claim 8, wherein said controlled cooling rate is approximately 50° F. per hour.

11. A method for heat treating aluminum-lithium alloys to improve formability, comprising the steps of:

providing an aluminum-lithium alloy having 3.5 to 4.5% by weight of copper, 0.8 to 1.2% by weight of lithium, 0.2 to 0.6% by weight of magnesium, 0.2 to 0.6% by weight of silver, 0.05 to 0.15% by weight of zirconium, and a balance by weight of aluminum;

heating the aluminum-lithium alloy to a first temperature of approximately 600° F.;

maintaining the aluminum-lithium alloy at said first temperature for a first time period not to exceed 16 hours;

heating the aluminum-lithium alloy at a controlled heating rate of approximately 50° F. per hour at the conclusion of said first time period to a second temperature of approximately 800° F.;

maintaining the aluminum-lithium alloy at said second temperature for a second time period not to exceed 12 hours;

actively cooling the aluminum-lithium alloy at a controlled cooling rate of approximately 50° F. per hour at the conclusion of said second time period to a third temperature of approximately 500° F.;

maintaining the aluminum-lithium alloy at said third temperature for a third time period not to exceed 4 hours; and passively cooling the aluminum-lithium alloy at the conclusion of said third time period to room temperature.

12. A method according to claim 11, wherein said first time period is approximately 15 minutes.

13. A method according to claim 11, wherein said second time period is approximately 4 hours.

14. A method according to claim 11, wherein said third time period is approximately zero.

15. A method according to claim 11, wherein said first time period is approximately 15 minutes, said second time period is approximately 4 hours, and said third time period is approximately zero.

* * * * *